United States Patent [19]

Brown

[11] Patent Number: 4,822,086

[45] Date of Patent: Apr. 18, 1989

[54] SECURITY GUARD DEVICE FOR DOORS

[76] Inventor: N. Keith Brown, Apt. 288, Hidden Lake Apartments, 15 Villa Rd., Greenville, S.C. 29615

[21] Appl. No.: 56,432

[22] Filed: Jun. 1, 1987

[51] Int. Cl.[4] ..... F05C 17/16

[52] U.S. Cl. ..... 292/338; 292/DIG. 15

[58] Field of Search ..... 292/338, 339, DIG. 15, 292/DIG. 61

[56] References Cited

U.S. PATENT DOCUMENTS

| | | | |
|---|---|---|---|
| 544,730 | 8/1895 | Kennedy | 292/338 |
| 705,804 | 7/1902 | Winn | 292/338 |
| 1,069,676 | 8/1913 | Clement | 292/338 |
| 1,110,628 | 9/1914 | Hendrix | 292/338 |
| 1,479,029 | 1/1924 | Dixon | 292/338 |
| 1,553,341 | 9/1925 | Vavra | 292/338 |
| 1,704,967 | 3/1929 | Fuller | 292/338 |
| 1,876,173 | 9/1932 | Sasgen | 292/338 |
| 1,944,783 | 1/1934 | Ciriacy et al. | 292/338 |
| 2,073,024 | 3/1937 | Potter | 292/338 |
| 2,491,246 | 12/1949 | Bloomfield | 292/338 |
| 3,006,676 | 10/1961 | Germock | 292/338 |
| 3,129,969 | 4/1964 | Chi Sneng Kuo | 292/338 |
| 3,141,188 | 7/1964 | Gray | 292/338 |
| 4,019,765 | 4/1977 | Nichola | 292/338 |
| 4,036,518 | 7/1977 | Jost | 292/339 |
| 4,070,049 | 1/1978 | Brewer | 292/338 |
| 4,136,899 | 1/1979 | Frasher | 292/338 |
| 4,157,128 | 6/1979 | Peters | 292/339 |
| 4,176,870 | 12/1979 | Cracraft | 292/338 |
| 4,300,079 | 11/1981 | Lane | 292/339 |
| 4,358,758 | 11/1982 | Morton | 292/339 |
| 4,456,291 | 6/1984 | Brogie | 292/338 |
| 4,563,027 | 1/1986 | Chechovsky et al. | 292/339 |
| 4,607,253 | 8/1986 | Wooten et al. | 292/337 |
| 4,607,870 | 8/1986 | Crisp | 292/338 |
| 4,641,869 | 2/1987 | Johnson | 292/339 |

FOREIGN PATENT DOCUMENTS

| | | | |
|---|---|---|---|
| 1019016 | 1/1977 | Canada | 292/339 |
| 296220 | 9/1915 | Fed. Rep. of Germany | 292/338 |
| 611569 | 11/1948 | United Kingdom | 292/338 |
| 2102495 | 2/1983 | United Kingdom | 292/339 |

OTHER PUBLICATIONS

Popular Science Article, Nov. 1941, p. 141, "Garage Door Stops".

*Primary Examiner*—Richard E. Moore
*Assistant Examiner*—Eric K. Nicholson
*Attorney, Agent, or Firm*—Cort Flint

[57] ABSTRACT

A door security guard device having adjustable telescoping elongated members permanently mounted on the door and being spring urged towards the surface of said door for storage when said device is not in use and for assuring a secure locking engagement when said device is in operation.

7 Claims, 2 Drawing Sheets

SECURITY GUARD DEVICE FOR DOORS

BACKGROUND OF THE INVENTION

This invention relates to a device for securing a door firmly against opening as a means of protection for the people inside the door.

Security devices for protecting the occupants of houses, stores, hotel rooms, and the like are many in number. A number of these devices are used to secure and/or lock doors against opening. Many of these devices have adjusting features so that doors of various sizes and heights may be secured with the same device. Such a device is usually comprised of an adjustable length bar or prop which is wedged between the doorknob and the floor of the room inside the door at an angle so that any attempt to open the door wedges the prop or bar tighter. Such props or levers or bars are generally removed when not in use and tend to be lost or mislaid.

Prior art patents known to applicant for similar devices are those found in U.S. Pat. Nos. 1,479,029; 1,944,783; 2,491,246; 4,019,765; 4,300,796; and 4,358,758.

SUMMARY OF THE INVENTION

An object of the present invention is to provide a security guard device for doors which prevents the opening of the door from outside of the room.

Another object of the present invention is to provide a security guard device for doors wherein the device is positively engaged with the door.

A still further object of this invention is to provide a security guard device for the door which automatically wedges itself between the door and the floor.

Yet another object of the invention is to provide a security guard device for a door which stores conveniently out of the way on the door when not in use.

The security guard device as disclosed in this application is unique and different from previous door guards in that it is fully adjustable and includes spring means for urging the security device into locking position and for urging the security device into a storage position when it is not in use.

The objects outlined hereinabove, together with other objects and advantages which will become apparent hereinafter, reside in the details of construction and operation as will be more fully described hereinafter in the specification and in the claims, reference being had to the accompanying drawings forming a part hereof wherein like reference characters refer to like parts throughout.

DETAILED DESCRIPTION OF THE DRAWINGS

Figure 1:
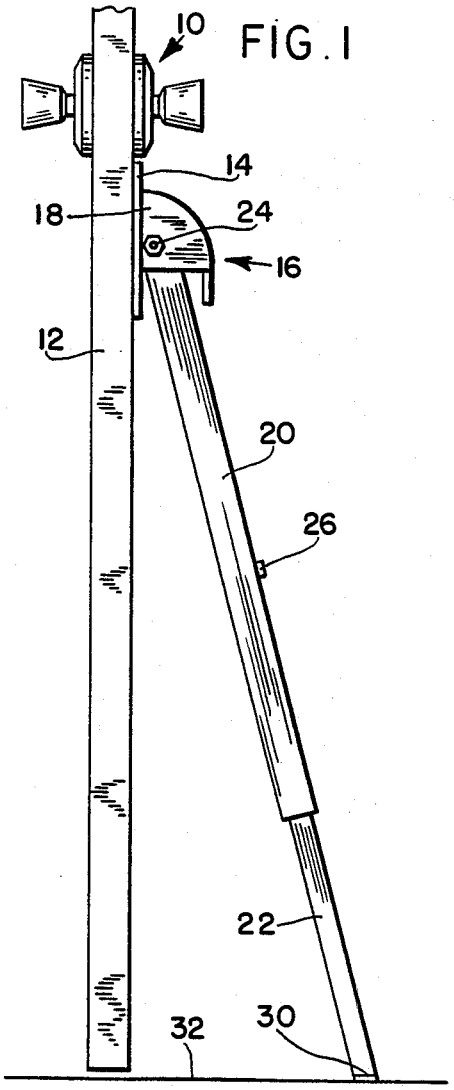
FIG. 1 is a side elevational view of a door with the security guard device of the invention.
Figure 2:
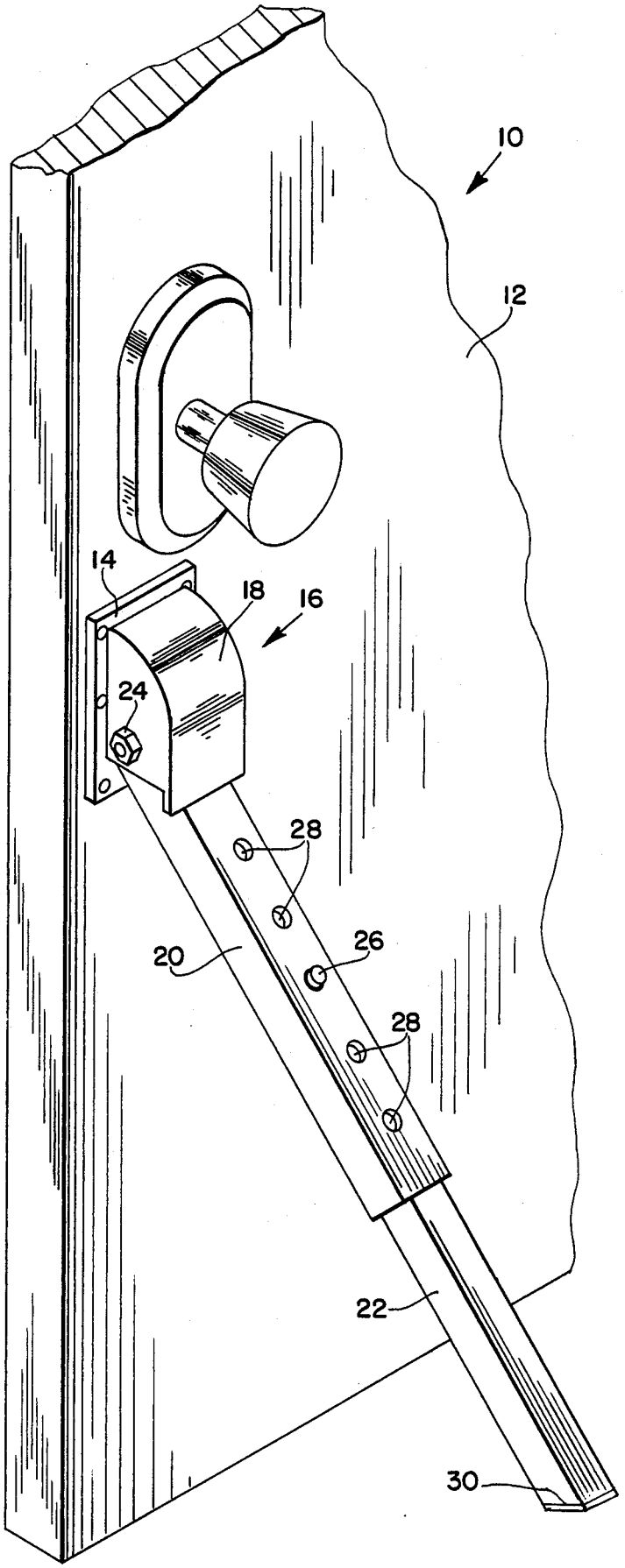
FIG. 2 is a front elevation of a door equipped with the security guard device of the invention.

FIG. 1 shows a door 10 in its closed position. The door 10 has conventional doorknobs and locks. Disposed beneath the doorknob is the security guard device 12. Security guard device 12 comprises a mounting bracket 14 which is held in place on the door by a plurality of screws 15. These screws may be wood screws or metal screws depending on the nature of the door or in some cases they may even be bolts.

Affixed to mounting bracket 14 is a support housing 16 which comprises a pair of spaced support arms 18 for supporting the security guard device which comprises a first elongated tubular member 20 fitted over a second elongated tubular member 22 and extends from the support housing 16 to the surface of the floor 32. The upper end of the first elongated member 20 is pivoted about a pivot shaft 24 which extends between the support arms 18 of the support housing.

The first elongated member 20 is provided with a plurality of openings 28 adapted to be engaged by a spring-loaded detent 26 in the second elongated member 22, for adjusting the length of the security guard device. The spring-loaded detent 26 is adjacent the upper end of the second elongated member 22. The lower end of the second elongated member 22 is equipped with a foot or boot 30 made of rubber or other friction material for engaging floor 32. The second elongated member 22 is adapted to fit within the first elongated member 20 so that its length can be varied according to the size and shape of the door by depressing the spring-loaded detent 26 and moving it to a different opening 28 in the first elongated member. This also permits the length of the security device to be shortened when it is not in use for storage purposes.

Figure 3:
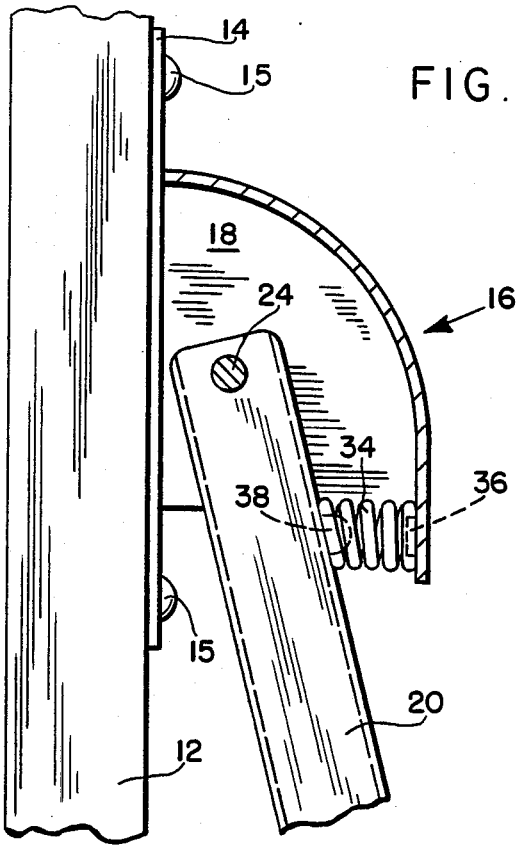
FIG. 3 is an enlarged view of a section taken along lines 3—3 of FIG. 2.

Referring now to FIG. 3, wherein the upper end of the first elongated member is mounted to pivot about pivot shaft 24 fixed in its location within the support housing 16. In this embodiment a compression spring 34 is supported housing 16. The opposite end of spring 34 fits about an anchor 38 on the upper end of the first elongated member 20 and urges the security device, comprising the first and the second elongated members, to pivot in a clockwise direction about pivot shaft 24. Thus, compression spring 34 urges the lower end of the second elongated member 22 into contact with the floor 32 whenever the door is closed, thereby assuring that the security device is engaged whenever the door is closed if the device has been activated. On the other hand, if the security device has been deactivated by shortening the security device by moving the second elongated member upward within the first elongated member so that the boot 30 no longer engages the floor, spring 34 will then urge the security device into abutting contact with the surface of door 10. Thus, while the security device is inactivated door 10 can be opened and closed normally with no interference from the security device. When it is desired to put the security device into operation the occupant of the room need only to adjust the length of the security device to permit it to contact floor 32 at a distance from door 10.

Figure 4:
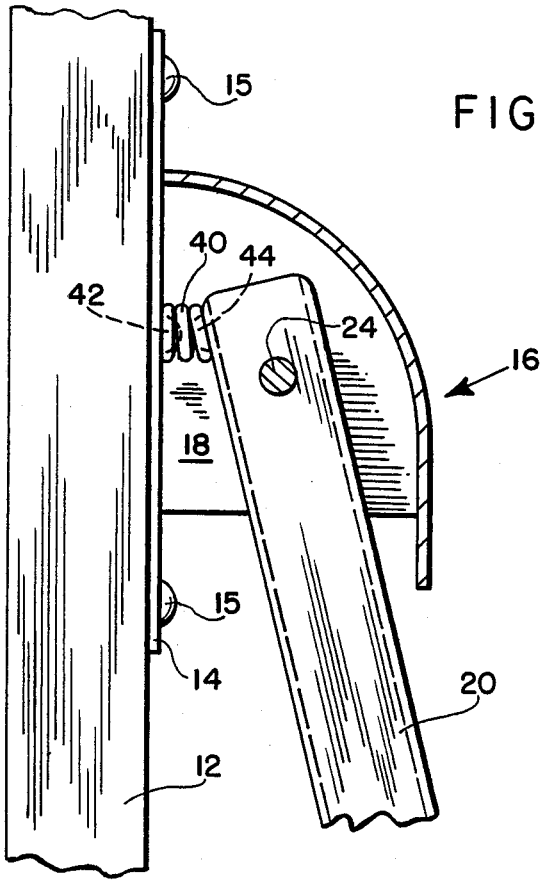
FIG. 4 is an enlarged view similar to FIG. 3 of a second embodiment of the invention.

Referring now to FIG. 4 wherein an alternative embodiment of the security devivce of the invention is illustrated. In this embodiment a compression spring 40 is interposed between the surface of bracket 14 and the upper end of the first elongated member 20 above pivot 24. In this embodiment the compression spring 40 is anchored to the plate of bracket 14 by means of a spring anchor 42 and fits about an anchor 44 on the upper end of a first elongated member 20 so that the compression spring will urge the security device comprising the first elongated member 20 and second elongated member 22 about pivot 24 in the clockwise direction as seen in FIG. 4. The security device of the second embodiment as seen in FIG. 4 functions in exactly the same way as did the embodiment illustrated in FIG. 3, as described above.

It is to be understood that the first and second elongated members will usually comprise steel tubing but that they can be of any configuration and form provided that the adjustable feature concerning their length is observed. It is preferred that the tubing be of rectangular cross-section. The sides intersect at sharp angles so that relative rotation between the tubing is prevented.

The foregoing description of the invention is considered as illustrative only of the principles of the invention. Since numerous modifications and changes will readily occur to those skilled in the art, it is not desired to limit the invention to the exact construction and operation shown and described herein. Accordingly, all suitable modifications and equivalents may be resorted to, provided they fall within the scope of the claims appended hereto.

What is claimed is:

1. A security guard device for a door having a doorknob comprising:

(a) a bracket adapted for being secured to said door adjacent said doorknob having a base affixed to the door and two spaced arms extending outwardly from said base;

(b) a first elongated member pivotally mounted at a fixed pivot which is fixed in a location between said arms;

(c) a second elongated member adjustably connected to said first elongated member for relative longitudinal movement with said first elongated members;

(d) a foot carried by said second elongated member for contacting the floor spaced from said door;

(e) said first and second elongated members sliding longitudinally with respect to each other and having an adjustable length extending generally from said doorknob to said floor;

(f) biasing means carried by said bracket for pivotally urging said first and second elongated members about said fixed pivot towards said door;

(g) said first and second elongated members having a deactivated position in which the total effective length of said first and second elongated members is less than the distance from said pivot to said floor;

(h) said biasing means directly biasing said first and second elongated members about said fixed pivot against said door to hold said guard device securely against said door in said deactivated position so that said door may be opened and closed freely;

(i) said first and second elongated members having an activated position in which the total length of said first and second elongated members is greater than the distance from said pivot to said floor for bracing said door in a secure, locked position;

(j) said biasing means biasing said elongated members about said fixed pivot for urging said foot against said floor tightly wedging said foot against said floor when said first and second elongated members are in said activated position so that said door is securely braced against opening; and (k) said biasing means including a compression spring urged against a face of said first elongated element near said fixed pivot generally within said bracket, said compression spring being compressed when said first and second elongated members are in said activated position to urge said second elongated member against said floor with a compressive force, and said compression spring urging against said face of said first elongated member in compression to hold said first elongated member against said door in said deactivated position.

2. A security guard device as set forth in claim 1, wherein said first elongated member comprises a tubular portion at the point said first elongated member is connected to said second elongated member.

3. A security guard device as set forth in claim 1, wherein said second elongated member is tubular at the point it is connected to said first elongated member.

4. A security guard device as set forth in claim 1, wherein said first and second elongated members are tubular and said second elongated member has a diameter less than that of said first elongated member.

5. A security guard device for a door as set forth in claim 4, wherein said first elongated member is provided with a plurality of openings arranged longitudinally along its surface and the upper end of said second elongated member is provided with a spring-loaded detent extending from the surface of said second elongated member for engagement with one of said openings in said first elongated member.

6. The device set forth in claim 1 including an integral bridge surface bridging and extending between said two spaced arms of said bracket; and a first spring anchor carried by said first elongated member for securing one end of said compression spring and a second spring anchor connected to said bridge surface for securing a second end of said compression spring.

7. The security guard device of claim 1 wherein said elongated members include:

(a) first and second elongated, tubular members each having a rectangular cross section;

(b) one of said tubular members being received in the other of said tubular members; and (c) said rectangular cross section of said first and second tubular members defining interlocking edges which prevent rotation of said first and second tubular members relative to each other so that twisting of said tubular members in said activated position is minimized when pressure is placed on said foot to where the door is sought to be opened.

* * * * *